US007753093B2

(12) United States Patent
Jenne

(10) Patent No.: US 7,753,093 B2
(45) Date of Patent: Jul. 13, 2010

(54) TIPLESS CAN FILLING VALVE

(75) Inventor: Richard D. Jenne, Willowick, OH (US)

(73) Assignee: Bevcorp, LLC, Willoughby, OH (US)

( * ) Notice: Subject to any disclaimer, the term of this patent is extended or adjusted under 35 U.S.C. 154(b) by 334 days.

(21) Appl. No.: 11/779,987

(22) Filed: Jul. 19, 2007

(65) Prior Publication Data

US 2008/0072995 A1 Mar. 27, 2008

Related U.S. Application Data

(60) Provisional application No. 60/826,499, filed on Sep. 21, 2006.

(51) Int. Cl.
*B65B 1/04* (2006.01)

(52) U.S. Cl. ..... 141/287; 141/57; 141/285

(58) Field of Classification Search ..... 141/57, 141/144–147, 285–287
See application file for complete search history.

(56) References Cited

U.S. PATENT DOCUMENTS 3,519,035 A * 7/1970 Remane ..... 141/52
3,534,788 A * 10/1970 Trusselle et al. ..... 141/392
3,626,996 A * 12/1971 Bingham et al. ..... 141/5
3,683,976 A * 8/1972 Remane ..... 141/59
4,089,353 A 5/1978 Antonelli
4,349,055 A 9/1982 DiChiara
4,442,873 A 4/1984 Yun
4,750,533 A 6/1988 Yun
4,938,261 A 7/1990 Petri et al.
4,979,546 A 12/1990 LaWarre, Sr. et al.
5,060,702 A 10/1991 LaWarre, Sr. et al.
5,085,255 A 2/1992 LaWarre, Sr. et al.
5,094,278 A 3/1992 Arao et al.
5,139,058 A 8/1992 Yun
5,141,035 A 8/1992 Nish et al.
5,150,740 A * 9/1992 Yun ..... 141/6
5,156,200 A * 10/1992 Mette ..... 141/46
5,190,084 A 3/1993 Diehl et al.
5,474,113 A 12/1995 Rademacher et al.
5,884,677 A 3/1999 McKaughan
5,924,462 A 7/1999 McKaughan
5,944,072 A 8/1999 Tietz et al.
5,954,100 A 9/1999 Nish et al.
5,960,838 A 10/1999 Tietz et al.
6,076,567 A 6/2000 Naecker et al.
6,082,418 A 7/2000 Naecker et al.
6,109,483 A 8/2000 Wilke et al.
6,112,778 A 9/2000 Nish et al.
6,131,624 A 10/2000 Paradies
6,135,166 A 10/2000 Paradies et al.
6,155,314 A 12/2000 Ding et al.
6,179,016 B1 1/2001 Neacker et al.

(Continued)

*Primary Examiner*—Timothy L Maust
(74) *Attorney, Agent, or Firm*—Hahn, Loeser & Parks, LLP

(57) ABSTRACT

A filling valve is provided for filling containers such as beverage cans. The valve includes a tipless nozzle having ports oriented for directing flow. The nozzle includes a removable valve seat having a planar sealing surface. A spring actuated vent seal is provided for closing the vent tube. The valve stem has protrusions for centering the stem in the valve body. The filling valve has a bell forming a cavity between the bell and the valve body, and an aperture for directing cleaning fluid from within the bell to the cavity. The valve body has a duct for directing cleaning fluid from the cavity to an outlet.

14 Claims, 9 Drawing Sheets

U.S. PATENT DOCUMENTS

| | | | |
|---|---|---|---|
| 6,223,435 | B1 | 5/2001 | Stavrakis |
| 6,230,767 | B1 | 5/2001 | Nelson |
| 6,244,309 | B1 | 6/2001 | Martin |
| 6,390,148 | B2 | 5/2002 | Martin |
| 6,397,909 | B1 | 6/2002 | Nelson |
| 6,484,762 | B2 | 11/2002 | Fehland et al. |
| 6,742,556 | B1 | 6/2004 | Osuna et al. |
| 7,127,870 | B2 | 10/2006 | McRay et al. |
| 2005/0086909 | A1 | 4/2005 | Krulitsch |

* cited by examiner

TIPLESS CAN FILLING VALVE

TECHNICAL FIELD

In automatic beverage filling machines, the developments relate to the filling valves associated with such machines to allow for more accurate and higher speed filling processes.

BACKGROUND

Beverage cans may be filled by automated container filling systems, wherein an empty can or other container is engaged with a filling valve, and the beverage dispenses from the filling valve into the can. One automated container filling system provides counterpressure filling, in which the can is filled with pressurized gas before the beverage is dispensed. In one counterpressure filling system, a filling valve includes a seal that expands against the top of the can, thereby sealing the inside of the can for containing pressurized gas.

In general, a plurality of cans move through a rotary filler. Empty cans are presented to the filling valve as the rotary filler turns. After the filling valve fills the can, the can moves off of the rotary filler. In valves associated with known machines, various deficiencies are found to effective and fast filling procedures. One problem noted with known valves relates to the liquid seal within the valve, which has a wedge-shaped sealing surface which contacts a wedge seal seat, wherein the liquid seal has the tendency to be frictionally engaged in a manner that causes hesitation when opening the valve, thereby causing a short fill. Further, the liquid seal seat formed in such known valves has been formed integral with the valve body, so that it is not replaceable apart from the entire valve. A further impediment to achieving desired fill time with the known valve relates to the use of a screen positioned just beneath the sealing surface to assist in stopping flow of the liquid upon valve shutoff. The position of the screen is well above the valve outlet, allowing a significant amount of liquid to continue to drip from the valve after closure, and causing delay in completion of the fill. Other delays in the filling process are found in the need to snift a significant volume of gas upon completion of the fill from the headspace in the valve. Loss of liquid contents also could occur by the liquid entering the space around a can sealing member during the fill process, and being retained in association with the valve behind the can sealing member. Additional problems with known valves are found in the manner in which liquid is directed into the can or other container. With a can, known valves direct the liquid in a spiral fashion, but introduce the liquid in a direction which is well below the top of the can. This can cause disruption in the flow of the liquid into the container as the fill height increases. Other problems, including limitations to proper cleaning of such valves and others, have been noted.

SUMMARY OF THE DISCLOSURE

One embodiment provides a filling valve for filling a container comprising a valve body having a chamber, and a nozzle being connected to the chamber. The nozzle comprises an outlet and a peripheral surface about a central axis, with an expandable seal operably positioned around the surface above the outlet, and capable of engaging a container; and at least one groove in the outer surface extending under the seal.

In an embodiment, the filling valve comprises a valve seat having at least one aperture connecting the valve body chamber with the nozzle. A closure valve is provided to selectively close the at least one aperture, to provide the capability of controlling a flow of fluid through the at least one aperture. A valve stem is connected to the closure valve, the valve stem comprising at least one boss for guiding the stem in the valve body chamber; wherein the valve stem and closure valve operatively move between a valve open and valve closed position.

DETAILED DESCRIPTION OF THE DRAWINGS

Figure 1:
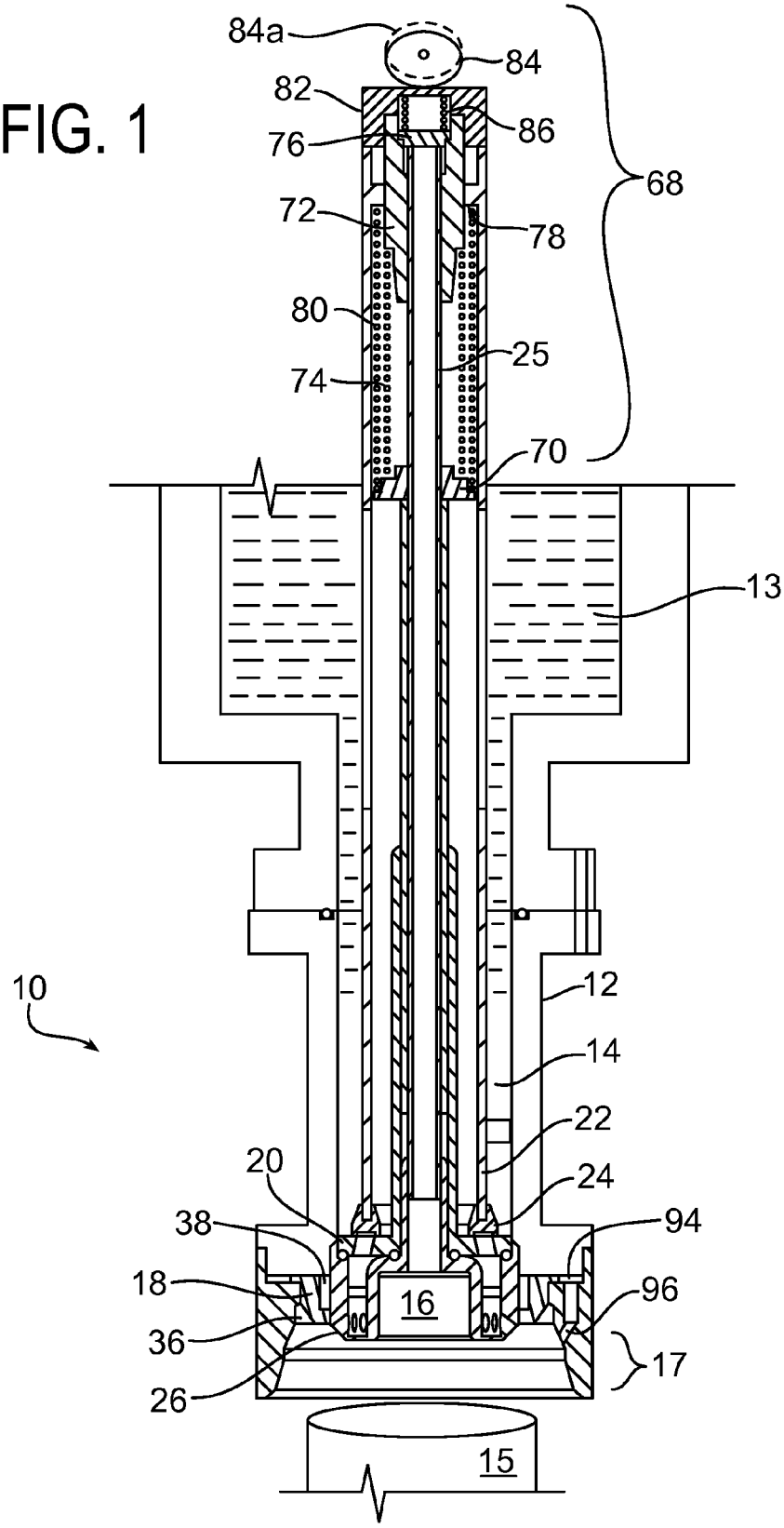
FIG. 1 is a partial cross sectional view through one embodiment of the filling valve.

The disclosure is directed to a filling valve which is generally functionally related to filling valves in widely used and long known filling machines, including but not limited to filling machines known as Crown filler machines. Turning to FIG. 1, the filling valve 10 is characterized by a generally cylindrical valve body, or housing 12, positioned with a reservoir 13 so that a liquid beverage or other fluid will selectively flow therethrough from the filling machine bowl or reservoir 13, through a valve sealing seat 20 and dispensing nozzle 16, to be dispensed into a beverage can or other container 15. The filling valve embodiment of FIG. 1 further comprises a bell 17 surrounding a dispensing nozzle 16 adjacent to container sealing member 18. A valve actuation system includes the valve seat 20, a valve stem 22, and a closure valve 24, cooperating to selectively operate the filling valve 10 between a valve-open position and a valve-closed position. In the embodiment of FIG. 1, a vent tube 25 is connected to the nozzle 16 and positioned within the valve stem 22. The vent tube 25 may be of a screw in type to be selectively screwed into engagement with the nozzle 16 or otherwise suitably attached. The filling valve 10 may operate between the valve-closed and valve-open positions by the operation of an actuating assembly, generally indicated 68, which is capable of selectively opening the vent tube 25 and lifting the valve stem 22 for selective opening and closing of the valve 10.

The filling nozzle 16 is positioned at an operative end of the filling valve for directing fluid into the container 15. In one embodiment, the container is presented so that a mouth or opening on the container is beneath the nozzle 16. A container nest or conveying apparatus may lift the container into a filling position. Alternatively, the filling valve may move into the filling position. Methods and devices for presenting an empty container, such as but not limited to a can, to a filling valve are generally known in the art.

In one embodiment, the filling valve 10 is arranged in a vertical axial orientation with the chamber 14 being cylindrical about a centerline axis. In the embodiment of FIG. 1, the reservoir 13 is positioned vertically above the housing 12 such that the reservoir 13 is in fluid communication with the chamber 14. In this embodiment, the valve stem 22 extends from within the housing 12 into the reservoir. In the embodiment of FIG. 1, fluid contained by the reservoir 13 flows from the reservoir into the valve body chamber 14 and into the valve stem 22 by the force of gravity. In alternate embodiments, the chamber 14 may not be cylindrical, and it is contemplated that the chamber 14 may be angled or oriented in other non-vertical positions.

In one counterpressure filling embodiment, the reservoir 13 contains fluid and a pressurizing gas above the fluid, or in the head space of the reservoir 13. In this embodiment, shown in FIG. 1, the vent tube 25 extends above the fluid level into the pressurizing gas. The pressurizing gas may selectively flow through the vent tube 25 and into the container, causing the container 15 and the reservoir 13 to be substantially at the same internal pressure above 1 atmosphere during the filling process, discussed below.

Figure 2:
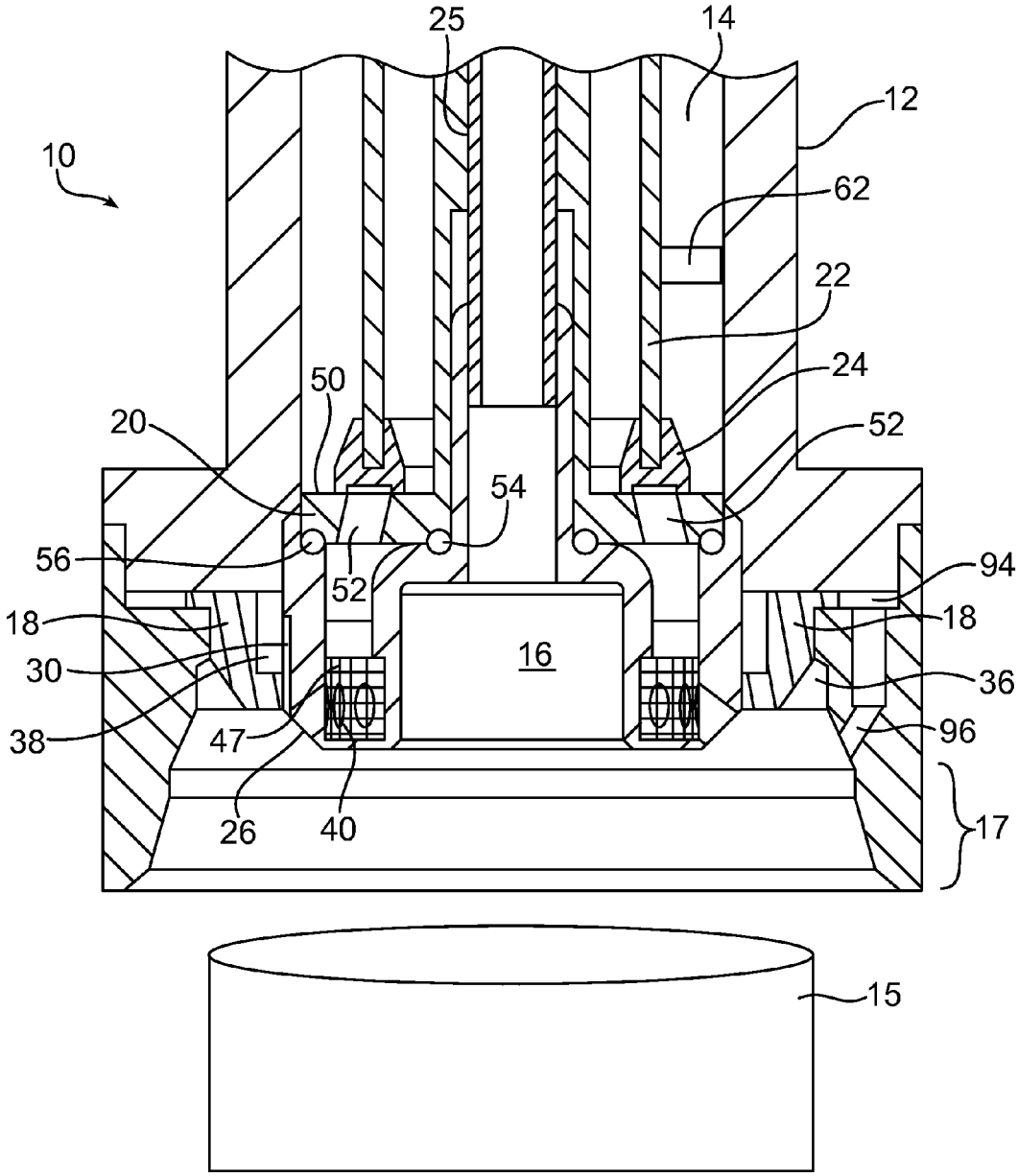
FIG. 2 is a partial cross sectional view through one embodiment of the filling valve, and FIG. 2A.
Figure 2A:
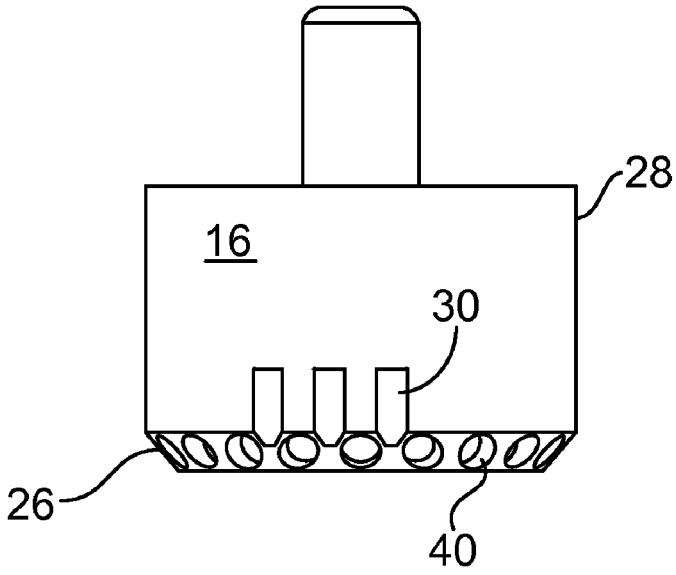

As shown in FIG. 2, the dispensing nozzle 16 may include at least one outlet 26 and a peripheral surface 28 about a central axis. As shown in FIG. 2, the nozzle peripheral surface 28 has a cylindrical shape. In this embodiment, the sealing member 18 is operably positioned around the peripheral surface 28 in close relationship and without interruption. Previously, a sealing member at this location included discontinuities to allow gas to pass through the space adjacent surface 28. As shown in FIGS. 2 and 2A, the peripheral surface 28 comprises one or more grooves 30 extending under the sealing member 18. Alternatively, one or more apertures may be used to allow pressurizing of the sealing member 18 as discussed below, while the close positioning of the sealing member about the surface 28 prevents the ingress of liquid to a position behind the sealing member 18.

In one automated container filling system, the containers and filling valves are positioned on a rotating table. In the rotary filling system, the grooves 30 may be positioned such that the grooves are oriented toward the center of the rotating table. In a rotary filling system, as the fluid is dispensed, centrifugal force lifts the fluid up the inner container surfaces oriented to the outside of the rotating table. By positioning the grooves 30 toward the inside of the rotating table, the centrifugally forced liquid does not enter the grooves 30. If apertures or the like are provided to pressurize the sealing member 18, they similarly may be positioned toward the inside of the rotating table so the centrifugally forced fluid may not enter the apertures.

Figure 3:
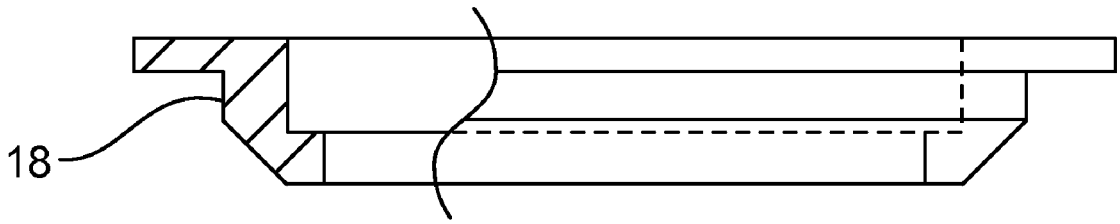
FIG. 3 provides a view of an embodiment of a seal member for a filling valve.

The sealing member 18 shown in FIG. 3, has a substantially uniform cross section, and is positioned such that when the seal 18 is installed on the nozzle surface, it is in close proximity to the nozzle peripheral surface 28 to substantially prevent flow of any liquids past the seal. The discontinuities in past sealing members enabled liquid to flow past and into a space 38 as shown in FIG. 2. The configuration of the seal 18 prevents migration and retention of such liquid to the space or cavity 38, which may otherwise be subsequently improperly released to result in waste of any retained product. In this embodiment, the seal 18 does not include any notches or other structures to allow flow of pressurizing gasses as in the prior art, but instead seals against the surface 28 as described. The sealing member 18 comprises a container sealing surface 34, and a mounting flange 36. The seal has a size for sealably engaging the inner walls of the container. In this embodiment, the seal 18 comprises a flexible and resilient material suitable for preventing pressurized liquid from passing between the seal 18 and the inner top surface of the container.

The seal 18 may be made from a flexible and resilient material such as, but not limited to, a thermoplastic elastomer or rubber. The seal 18 comprises a shape such that the seal flexes or expands when the space behind the seal, or the seal cavity 38, is filled with pressurizing gas, causing further engagement of the container sealing surface 34 with the inner walls of the container. Thus, the seal is capable of sealing against the container when in the expanded or flexed position, thereby sealing the nozzle in the mouth or opening of the empty container and holding the pressurizing gas in the container at a selected pressure. When the pressurizing gas in the seal cavity 38 is released, the seal returns to its original shape and position.

With reference to FIG. 2, the empty container 15 may be lifted into a filling position having a sealing engagement with the seal 18 sufficient to hold the pressurizing gas in the container. When the empty container is provided in the filling position, the pressurizing gas flows through the vent tube 25 and into the container 15. From the container 15, the pressurizing gas passes through the grooves 30 under the seal 18, filling the seal cavity 38 and causing the seal to flex or expand into further engagement of the container sealing surface 34 with the top interior walls of the container. The expanded seal 18 provides sufficient engagement with the container to allow additional pressurizing gas to be released into the container to achieve a pressure inside the container greater than 1 atmosphere. After the container is pressurized to substantially the same pressure as the pressure in the reservoir 13, liquid from the reservoir flows into the container 15 by way of the nozzle outlet(s) 26.

Figure 4A:
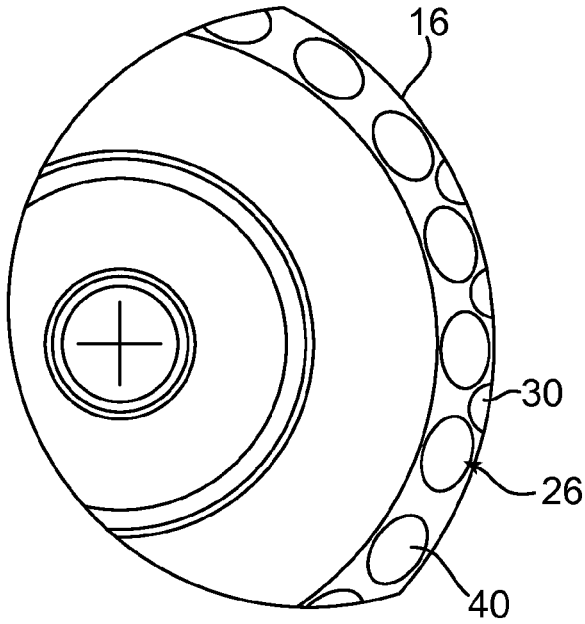
FIGS. 4*a*-4*b* provide views of a nozzle head with dispensing openings formed therein.
Figure 4B:
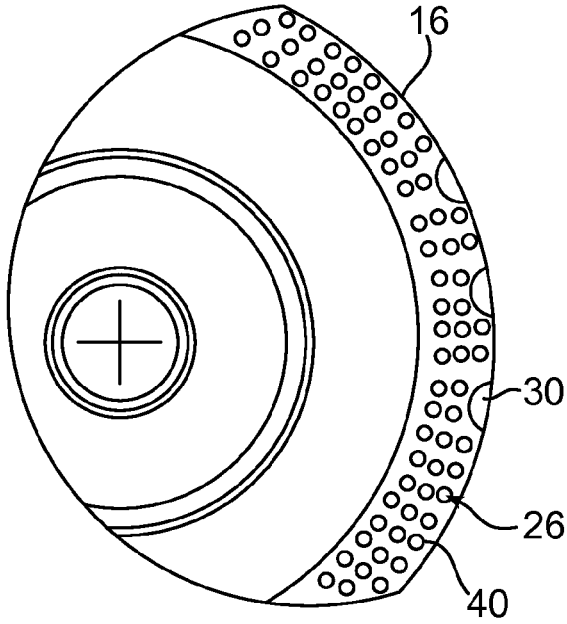

In one embodiment with reference to FIGS. 4A and 4B, the at least one nozzle outlet 26 may comprise a plurality of ports 40. The ports 40 comprise openings substantially level with an outer surface of the nozzle 26, and directional passageways in the nozzle. The directional passageways have inlets that are selectively in communication with the valve body chamber 14. In one embodiment, the ports 40 dispense fluid in a laminar flow. The passageways of the ports 40 may be oriented to dispense fluid in a downwardly direction defined by an outward angle, and possibly a tilt angle. The nozzle ports 40 may direct fluid in a direction having only an outward angle, only a tilt angle, or a combination of outward and tilt angles.

In one embodiment, the outward angle may be defined as an angle from a transverse plane perpendicular to the central axis of the nozzle 16. The outward angle may be provided for directing fluid against an inner wall of the container 15 during the filling operation. In one embodiment, the outward angle is within a range of approximately 30° to 70° from the transverse plane. In another embodiment, the outward angle is approximately 50° from the transverse plane. The outward angle may be selected to cooperate with the container being filled to decrease the amount of turbulent flow and increase the amount of laminar flow. Some containers, such as certain beverage cans, may have a lip or ridge near the mouth of the container. When filling containers with a lip or ridge, the outward angle may be selected to direct the flow of fluid against the inner wall of the container at a location beneath the lip or ridge.

The tilt angle may be defined as an angle from a radial plane parallel to the central axis of the nozzle 16. The tilt angle may be provided for directing fluid in a swirling direction during the filling operation of a cylindrical, spherical, or otherwise rounded container. In one embodiment, the tilt angle is within a range of approximately 10° to 40° from the radial plane. In an alternate embodiment, the tilt angle is approximately 20° from the radial plane. It is contemplated that the tilt angle may be selected to cooperate with the container being filled to decrease the amount of turbulent flow and increase the amount of laminar flow. The ability to provide laminar flow directed in a predetermined manner for any particular container 15 allows for faster fill times without having the liquid escape from the container due to the centrifugal force of a rotary filler for example.

In the nozzle embodiment as shown in FIG. 4A, the outlet 26 may comprise a number of ports 40 arranged around the nozzle, each port opening having a predetermined diameter, with a predetermined number of ports 40 provided. Depending on the filling requirements, the number of ports 40 are designed to enable a volume of liquid to pass therethrough in a predetermined period of time. For example, the number or ports 40 may be between 15 and 25, and have a diameter of approximately 0.15 to 0.20 inches, such as shown in FIG. 4A, or for example may comprise between 35 and 45 ports, each having an opening diameter of approximately 0.08 to 0.15 inches. Other nozzle embodiments are contemplated, such as having a larger number of ports 40, such as between 120 to 150, each having a port opening diameter, such as between 0.002 to 0.006 inches, such as shown in FIG. 4B. In a further embodiment, one port having an outward angle, and optionally a tilt angle, may be used. It is contemplated that the nozzle 16 may comprise any suitable number of ports for dispensing fluid into the container.

The configuration of ports 40 may be chosen with a balance of number of ports 40 relative to the diameter, to provide volume flow balanced with capillary action by the port size for reducing the flow of fluid from the ports when the valve is in the valve-closed position. Configurations allow for much faster fill times, up to 0.4 seconds faster than conventional systems. Thus, in one embodiment, the number of ports 40 is determined by considering the overall flow rate of fluid through the nozzle 16 compared to the amount of fluid that continues to flow from the ports after the filling valve is closed.

A screen 46 may be positioned between the valve body chamber 14 and the outlet 26. In the embodiment of FIG. 2, the screen 46 is vertically positioned inside the nozzle to cover the passageway inlets of the ports 40. By positioning the screen inside the nozzle 16, the screen 46 is generally protected from ambient air, and thus is maintained in the relatively acidic environment of the liquid and maintains cleanliness of the screen 46. In the embodiment of FIG. 2, the screen comprises a substantially cylindrical shape, positioned coaxially within the nozzle. In one embodiment, the screen is between 20 and 40 mesh. It is contemplated that the screen configuration may have a mesh size larger or smaller to accommodate the liquid being dispensed. The screen 46 may provide surface tension characteristics to restrict gas passage from the container 15 to the reservoir 13 when the filling cycle is complete but the valve is still open, and facilitates preventing flow of any liquid through the ports 40 when the valve is in the valve-closed position. The position of the screen 46 is also as low in the valve 10 as possible, and almost at the height of liquid in a container upon filling. This positioning provides less delay at the end of a fill cycle when a ball valve (not shown) seats in the vent tube as the liquid height reaches the fill height. Upon seating of a ball valve in association with the vent tube to stop flow of liquid, the position of the screen 46 eliminates any waiting for the last of the liquid product to run down into the container 15. This positioning also allows for a closer tolerance on the actual fill height of the container.

Figure 5A:
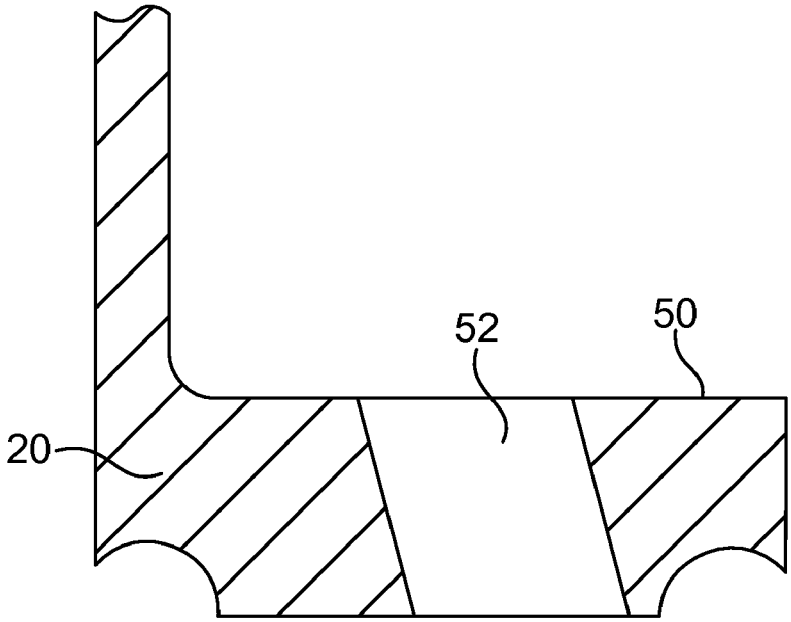
FIGS. 5*a* and 5*b* provide views of an embodiment of a valve seal for a filling valve.
Figure 5B:
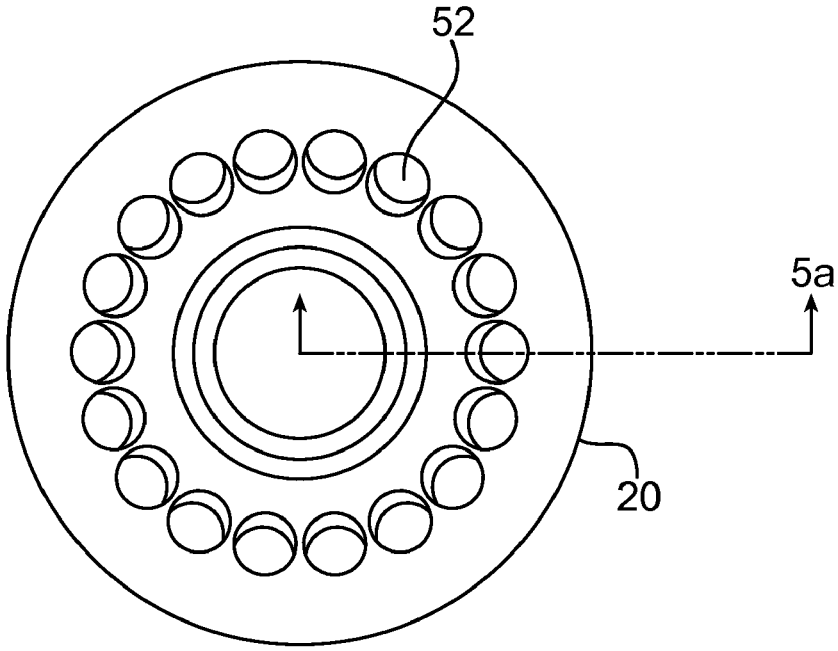

With reference to FIG. 2 and FIGS. 5A and 5B, a replaceable valve seat 20 may be provided in the nozzle 16. In one embodiment, the valve seat 20 comprises a substantially flat surface 50, and at least one aperture 52 through the valve seat 20 for connecting the valve body chamber 14 with the nozzle. In the embodiment of FIG. 5, between 15 and 20 cylindrical apertures are used. In this embodiment, the apertures pass through the valve seat 20 at an angle. In this embodiment, the valve seat 20 is selectively removable from the filling valve, to allow different fill characteristics to be achieved. As shown in FIG. 2, the valve seat 20 may be installed in the nozzle 16 with an inner o-ring 54 and an outer o-ring 56 to seal the valve seat 20 in association with the valve. Alternatively, the valve seat is integrated into the housing 12. It is contemplated that the shape of the apertures 52 through the valve seat 20 may be cylindrical or slots or other shapes. In an alternate embodiment, the valve seat comprises one or more conical surfaces comprising apertures. The ability to exchange the valve seat 20 may therefore allow the valve 10 to be reconfigured for different sized containers for example, such as smaller cans. The valve 10 may have the body reconfigured with a smaller nozzle to accommodate a smaller container 15, with the liquid seat 20 still fitting for use therewith.

Figure 6A:
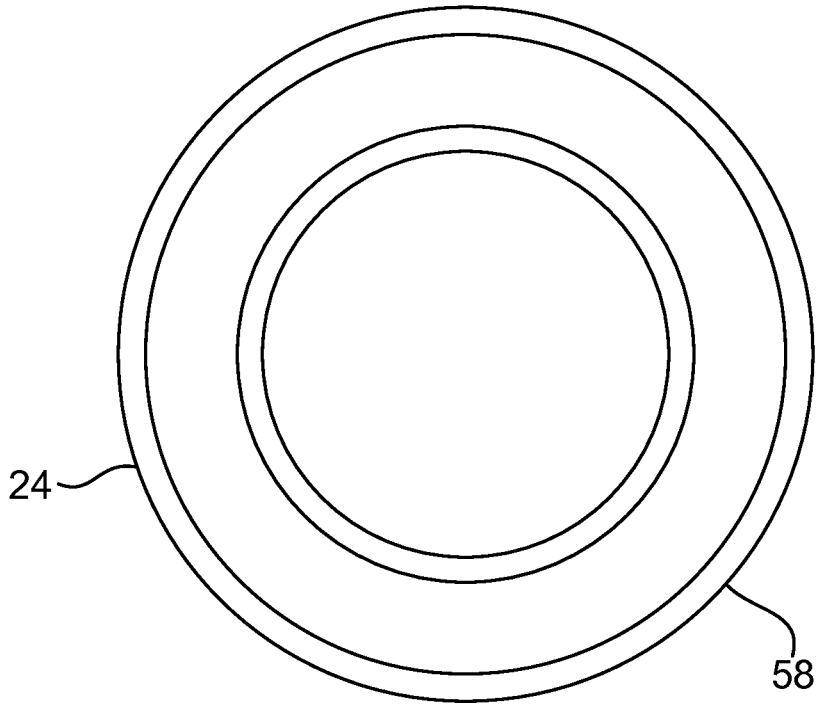
FIGS. 6*a* and 6*b* provide views of one embodiment of a valve closure seal for a filling valve.
Figure 6B:
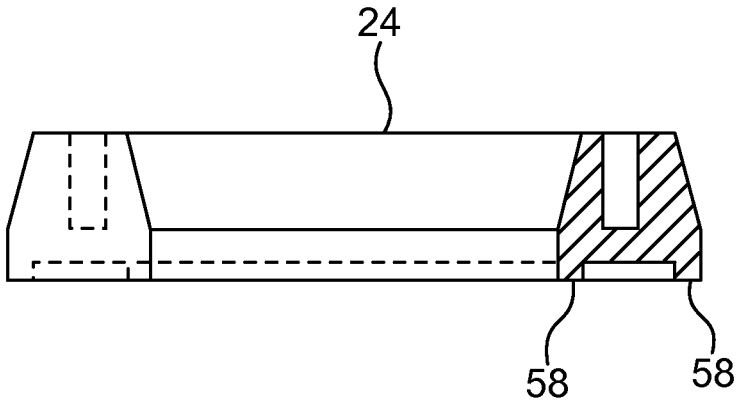

As shown in FIG. 2 and FIGS. 6A and 6B, the closure valve 24 is configured to control the flow of fluid through the at least one aperture 52. The closure valve 24 may be configured to close the at least one apertures 52 when the filling valve 10 is in the valve-closed position. In one embodiment, the closure valve 24 engages the flat surface 50. In the embodiment of FIG. 6, the closure valve 24 comprises one or more protrusions 58 for sealing against the flat surface 50. In this embodiment, the bosses 58 encircle the apertures 52. One or more bosses 58 may encircle one or more apertures 52. Alternately, bosses 58 may be configured to enter the apertures 52 in sealing engagement. The closure valve 24 may comprise a flexible and resilient material suitable for preventing pressurized liquid from passing between the closure valve 24 and the valve seat surface 50. Providing the seat surface 50 as a flat surface allows for proper sealing without undue engagement of the seating surface 50 with the closure valve 24 allows for faster filling without possible short fills due to sticking of the closure valve 24 upon filling.

Figure 7:
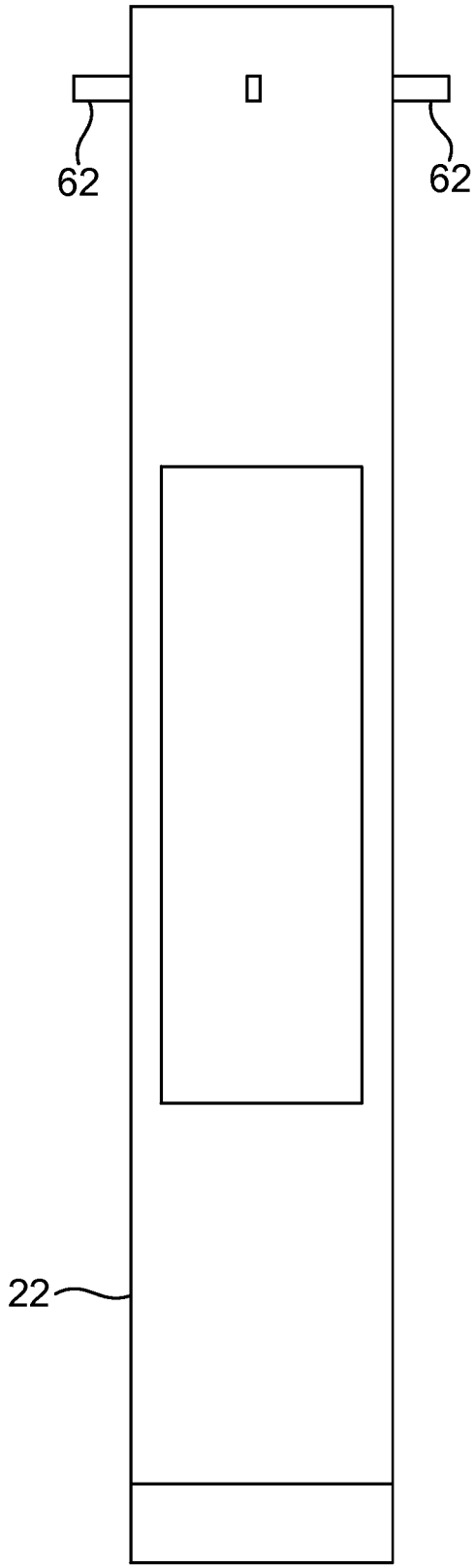
FIG. 7 provides views of one embodiment of a valve stem for a filling valve.

The closure valve 24 is affixed to the valve stem 22 to allow opening and closing of the valve. As seen in FIG. 7, the valve stem 22 may comprise at least one boss 62 for guiding the stem 22 in the valve body chamber 14. In the embodiment of FIG. 7, the valve stem comprises a plurality of bosses 62 situated at 90 degree spacing around the stem 22. The bosses 62 may be integrally formed or separately attached. In Other configurations to center the stem 22 without undue restriction to the movement of stem 22 are contemplated.

The filling valve of FIG. 1 further comprises the actuating assembly 68 capable of selectively moving the valve stem 22 and closure valve 24 between the valve open and valve closed position. In one filling valve embodiment, the actuating assembly 68 lifts up to move the valve stem 22 and closure valve 24 into the valve-open position, and presses down to move the valve stem 22 and closure valve 24 into the valve-closed position.

Figure 8:
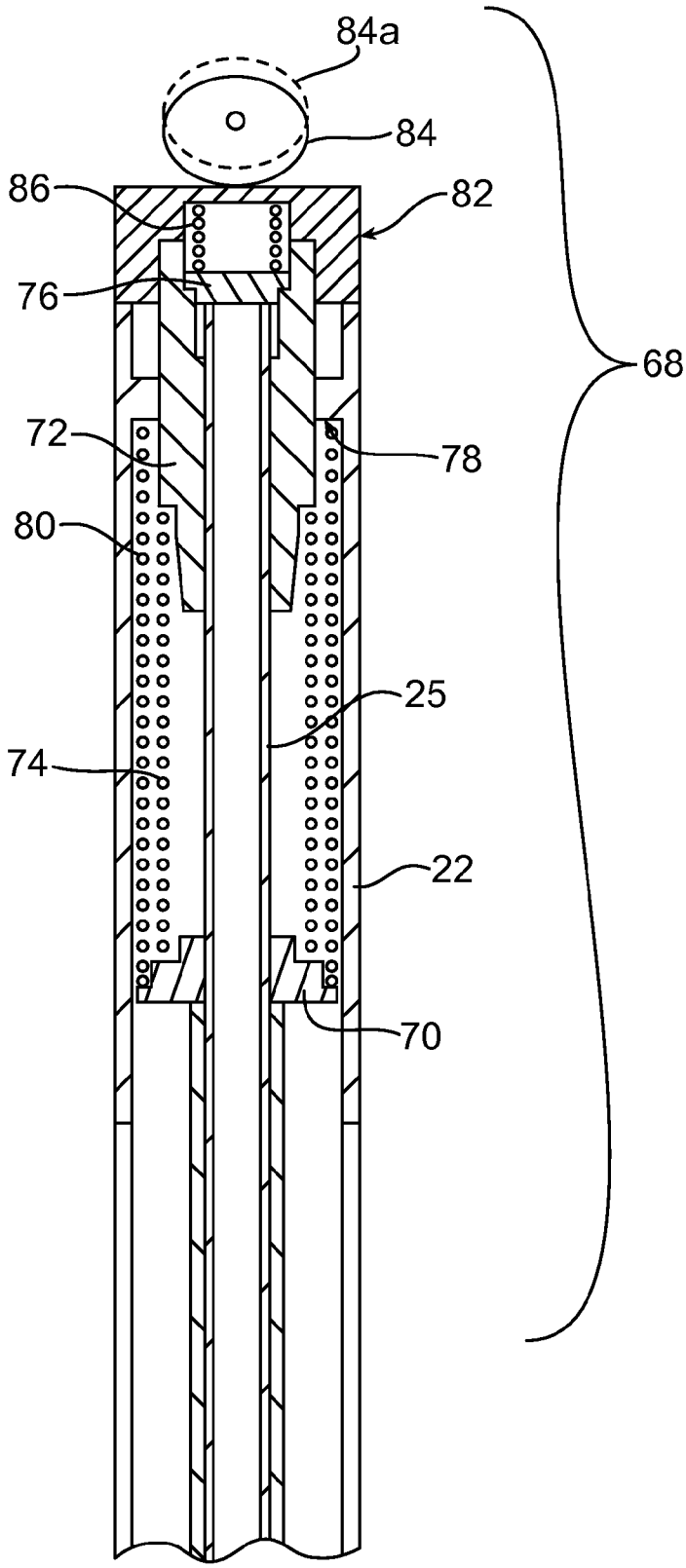
FIG. 8 provides a view of an embodiment of an actuating system for a filling valve.

As seen in FIG. 8, the actuating assembly 68 comprises an arrangement of systems and associated spring biasing members to allow for selected movement from and back to initial positions between valve open and closed conditions. Situated within the upper portion of housing 14, a counter pressure cap and assembly is provided, along with a valve seal actuating assembly. These assemblies allow for actuation of the valve operations in a desired sequence. A lower spring seat 70, an upper spring seat 72, and a pressure spring 74 operably positioned between the lower spring seat 70 and the upper spring seat 72. In this embodiment, the lower spring seat 70 is positioned within the valve stem 22, and is in a fixed position relative to the valve seat 20 and the vent tube 25. The upper spring seat 72 may be positioned within the valve stem 22 above the lower spring seat 70, capable of translating in an axial direction adjacent to the vent tube 25. A vent seal 76 is operably positioned at the end of the vent tube 25 and capable of sealing the vent tube. The upper spring seat 72 and the vent seal 76 cooperate such that when the upper spring seat 72 translates axially upward, the upper spring seat 72 causes the vent seal 76 to disengage and thereby open the vent tube 25.

In this embodiment, the valve stem 22 comprises a stem spring seat 78 located within the valve stem and vertically positioned above the lower spring seat 70. A valve spring 80 is operably positioned between the lower spring seat 70 and the stem spring seat 78.

The actuating assembly 68 further comprises a cap 82 positioned above the valve stem 22, and a valve cam 84 capable of controlling the height of the cap 82. In one embodiment, the cap 82 translates axially up and down between an upper and a lower position, floating against the operatively moving valve cam 84, the cam being shown in an upper position 84*a* in FIG. 1. In this embodiment, the valve cam 84 provides a downward force on the cap 82 when moving to the lower position. As the cap 82 moves to the lower position, the cap pushes the upper spring seat 72 downward, thus compressing the pressure spring 74. When the valve cam 84 moves to the upper position, the pressure spring 74 presses the upper spring seat 72 against the cap 82, causing the upper spring seat 72 and the cap to translate upward with the valve cam 84.

The cap 82 may further be capable of pressing the vent seal 76 against the vent tube 25 when the cap 82 is in the lower position. In one embodiment, the cap 82 and the vent seal 76 are combined into one part.

In one embodiment, the vent seal is spring actuated, with a vent spring 86 operably positioned between the vent seal 76 and the cap 82 such that when the cap moves to the lowered position, the vent spring 86 presses the vent seal 76 against the vent tube 25 in sealing engagement. The vent spring 86 may be positioned to accommodate over-travel of the valve cam 84, for reducing or preventing damage of the vent seal 76, and vent tube 25. In this embodiment, the cam 84 may be set such that moving the cam to the cam lower position moves the closure valve 24 and valve stem 22 to close the valve seat 20. If in closing the valve seat 20 the cam 84 presses down farther than the distance required to close the vent tube 25, the vent spring 86 may absorb the excess travel of the cap 82 and cam.

In this embodiment, the cap 82 and the upper spring seat 72 cooperate such that when the cap moves to a lowered position, the cap causes the upper spring seat 72 to translate axially downward. Further, when the cap 82 is in the lowered position, the cap holds the valve stem 22 and correspondingly the stem spring seat 78 such that the valve seat 20 is closed and the valve spring is compressed. Thus, when the cap is in the lowered position, the cap causes the pressure spring 74, the valve spring 80, and the vent spring 86 to be compressed, the vent tube 25 being sealed by the vent seal 76, and the valve seat 20 being closed by the closure valve 24. Thus, when the valve cam 84 and cap 82 are in the lowered position, the filling valve 10 is in the valve-closed position.

When the valve cam 84 moves to the raised position, the compressed pressure spring 74 expands, lifting the upper spring seat 72. In this embodiment, the moving upper spring seat 72 pushes the cap 82 and the vent seal 76 axially upward, causing the vent seal 76 to disengage, thereby opening the vent tube 25. When the valve cam 84 moves to the open position 84*a*, the compressed pressure spring 74 causes the upper spring seat 72 to disengage the vent seal 76 from the vent tube 25. As described previously, the reservoir 13 may contain fluid and a pressurizing gas above the fluid. When the vent seal 76 disengages from the vent tube 25, the pressurizing gas in the head space of the reservoir flows through the vent tube and into the container. Once the pressure in the container substantially equals to the pressure in the reservoir 13, the compressed valve spring 80 overcomes the pressure in the reservoir holding the valve stem 22 and closure valve 24 against the valve seat 20, causing the valve stem 22 and closure valve 24 to lift, thereby opening the valve seat. Fluid then flows into the container. Thus, when the valve cam 84 moves to the open position 84*a*, the filling valve moves to the valve-open position.

As the fluid level rises in the container, the pressurizing gas in the container is forced back through the vent tube 25 and into the reservoir 13. When the container is filled with fluid, pressurizing gas remains in the container above the fluid. The valve cam 84 then moves to the lowered position, pressing the cap 82 down causing the valve to close. A snift valve causes the pressurizing gas in the container to vent, returning the container to atmospheric pressure. The head space in housing 12 where gas remains after filling is reduced such that the volume of gas required to be snifted is smaller, thereby allowing faster operation.

Figure 9:
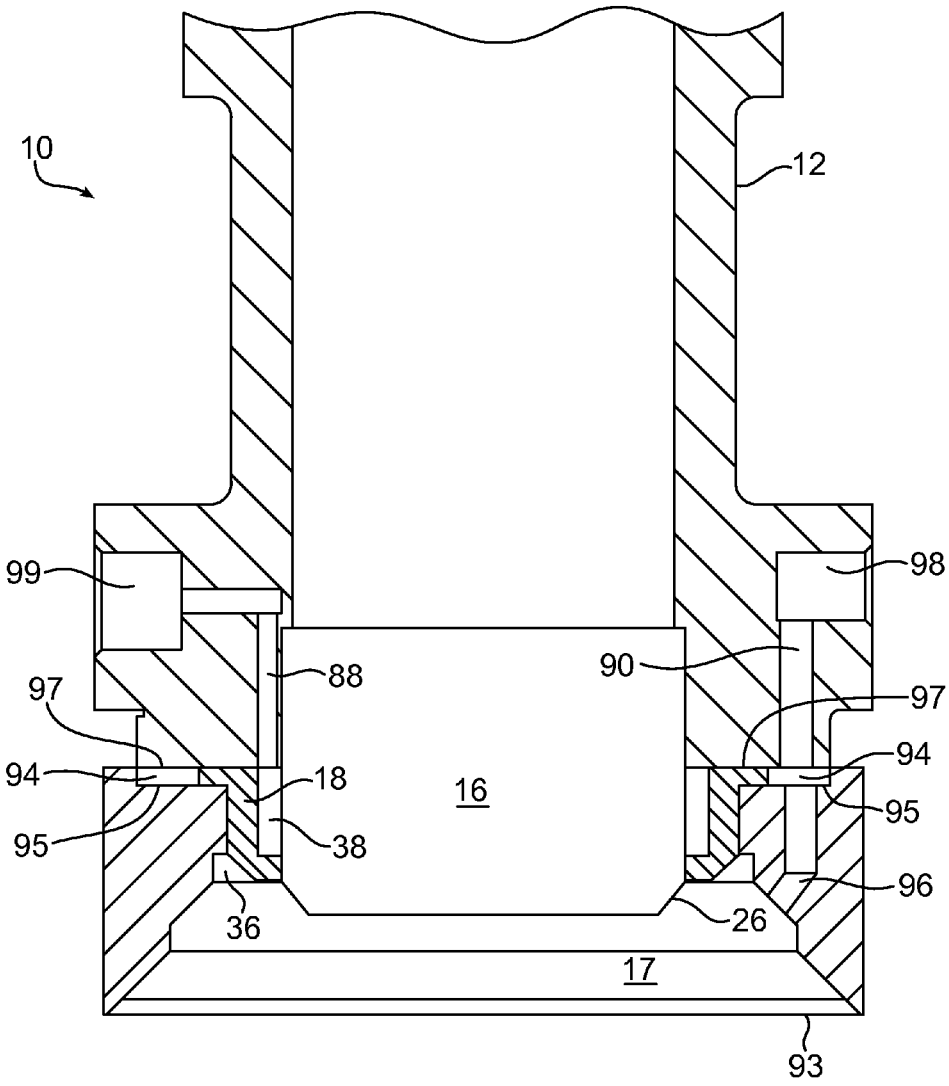
FIG. 9 is a partial cross section through a valve showing a clean-in-place system associated therewith.

The fill valve 10 may also have a clean-in-place (CIP) system associated with housing 12. A first housing passageway 88 and a second housing passageway 90 may be formed in the housing 12. The first housing passageway 88 connects the seal cavity 38 to the snift valve. In the embodiment as shown in FIG. 9, the first housing passageway 88 comprises an aperture through a wall of the housing for directing pressurizing gas from the seal cavity 38 to the snift valve (not shown) positioned at 99.

The bell 17 is capable of surrounding the opening of the container 15 when the container is in the filling position. The bell 17 may have a substantially cylindrical shape having an inner area 92 surrounding the nozzle 16, and a lower opening 93 through which the container 15 is positioned. The bell 17 attaches to the housing 12 forming a fluid cavity 94 between a lower surface of the valve body, or housing 12, and an upper surface of the bell. The bell 17 comprises a bell passageway 96, or duct, connecting the bell inner area 92 to the fluid cavity 94. An inner upper surface 95 of the bell 17 presses the mounting flange 36 of the seal 18 against a lower surface 97 of the housing 12. In this embodiment, the fluid cavity 94 is an area bounded by the mounting flange 36, the housing lower surface 97 and the bell upper surface 95. The fluid cavity 94 may extend 360° around the filling valve 10.

The second housing passageway 90 connects the fluid cavity 94 to an outlet 98. In the embodiment of FIG. 2, the second housing passageway 90 comprises an aperture through a wall of the valve body, or housing 12, for directing fluid from the fluid cavity 94 out of the housing. In one embodiment, the fluid cavity 94 extends less than 360° around the filling valve 10, extending approximately from the bell passageway 96 to the second housing passageway 90.

In one embodiment, the filling valve may be cleaned by filling the reservoir 13 with a cleaning fluid and circulating the cleaning fluid through the filling valve 10. In one cleaning method, a cleaning cup is positioned to sealably engage a lower portion of the bell 17, preventing fluid from flowing out of the lower opening 93 of the bell. In this embodiment, a cleaning fluid conduit is affixed between the second housing passageway 90 to direct cleaning solution out of outlet 98 to a remote recirculating pump and back to the reservoir 13.

When the filling valve is opened, cleaning fluid flows out of the reservoir 13, through the nozzle 16 and into the bell inner area 92. The cleaning fluid flows through the bell passageway 96 into the fluid cavity 94. The cleaning fluid flows from the fluid cavity 94 into the second housing passageway 90, through the cleaning fluid conduit and outlet 98 to a remote recirculating pump and back to the reservoir 13. In one cleaning method embodiment, the cleaning fluid is circulated at an elevated temperature. The cleaning fluid may be maintained in a temperature range of approximately 185-190° F. (approximately 85-88° C.). In one method embodiment, the fluid circulates for approximately 20 minutes. In this embodiment, the CIP system provides more uniform and thorough cleaning of the valve surfaces. The CIP discharge port 98 is routed through the centering bell 17 and into the CIP port in the valve body where it is sent to the main return line. As the snift actuator (not shown) positioned at 99 is operated during cleaning, the CIP solution is made to pass around the inside of the seal 18, for proper cleaning of all surfaces. This arrangement eliminates a CIP button on a two button valve, which would sometimes allow leakage past the valve when associated o-rings wear causing a low fill/no fill container on that valve. It also would allow drainage from the CIP piping to drip into a can in the valve. The new design will allow The CIP solution to enter into a port drilled into the upper interior portion of the bell (well away from the can opening) and lead into an isolated channel formed by the bell when screwed onto the valve. A second port hole is drilled into the back of the valve body and exits into a hose fitting which allows the CIP solution to be returned back to the CIP skid where it is re heated and returned to the filler While the invention has been illustrated and described in detail in the foregoing drawings and description, the same is to be considered as illustrative and not restrictive in character, it being understood that only illustrative embodiments thereof have been shown and described and that all changes and modifications that come within the spirit of the invention are desired to be protected. Additional features of the invention will become apparent to those skilled in the art upon consideration of the description. Modifications may be made without departing from the spirit and scope of the invention.

What is claimed is:

1. A filling valve for filling a container comprising:

a valve body having a chamber;

a nozzle being connected to the chamber, the nozzle comprising an outlet and a peripheral surface about a central axis;

an expandable sealing member operably positioned around the peripheral surface without interruption for substantially preventing liquid from flowing into an area about the peripheral surface, and positioned above the outlet for sealably engaging a container, the seal being capable of being expanded by a pressurizing gas;

at least one aperture in the nozzle extending under the sealing member; and a vent tube positioned vertically above the nozzle and being capable of selectively communicating pressurizing gas for expanding the sealing member.

2. The filling valve of claim 1, the outlet comprising:

a plurality of ports oriented in a downwardly direction defined by an outward angle and a tilt angle, the ports being positioned below the peripheral surface and each having an inlet in communication with the valve body chamber.

3. The filling valve of claim 2, where the outward angle is within a range of approximately 30° to 70° from a transverse plane, and the tilt angle is within a range of approximately 10° to 40° from a radial plane.

4. The filling valve of claim 3, wherein the tilt angle is selected to form a swirl of liquid in association with the side walls of a container as the liquid is dispensed into the container.

5. The filling valve of claim 2, the plurality of ports having predetermined sizes to allow predetermined volumetric flow therethrough.

6. The filling valve of claim 2, further comprising a screen vertically positioned inside the nozzle and covering the port inlets.

7. The filling valve of claim 1, further comprising:

a valve seat having at least one aperture connecting the valve body chamber with the nozzle and a substantially planar sealing surface around the at least one aperture; and a closure valve selectively engaging the sealing surface, capable of controlling the flow of fluid through the at least one aperture.

8. The filling valve of claim 7, the closure valve comprising a flexible seal capable of stopping the flow of fluid through the at least one aperture when the flexible seal is operably contacting the sealing surface.

9. The filling valve of claim 7, where the valve seat is capable of being removed from the valve.

10. The filling valve of claim 1, further comprising:

a valve seat having at least one aperture connecting the valve body chamber with the nozzle, the valve seat having a substantially planar sealing surface around the at least one aperture;

a closure valve being capable of selectively closing the at least one aperture by engaging the planar sealing surface for controlling a flow of fluid through the at least one aperture; and a valve stem connected to the closure valve capable of operatively moving between a valve open position and a valve closed position, the valve stem comprising at least one outwardly extending boss for guiding the stem within the valve body chamber.

11. The filling valve of claim 10, where the at least one boss comprises three or more bosses positioned about the periphery of the valve stem for centering the stem in the chamber.

12. The filling valve of claim 1, further comprising:

a valve stem being capable of operatively moving between a valve open position and a valve closed position;

a cap being vertically positioned above the valve stem and vent tube and selectively contacting the valve stem; and a valve cam being positioned above the cap, the valve cam being capable of pushing the cap and valve stem axially downward into the valve closed position.

13. The filling valve of claim 12, further comprising:

a vent seal capable of closing the vent tube positioned beneath the cap;

a spring positioned between the cap and the vent seal, the spring being capable of pressing the vent seal against the vent tube for closing the vent tube when the cap and valve stem are in the valve closed position.

14. The filling valve of claim 1, further comprising:

a bell being connected to the valve body and having an inner area surrounding the nozzle, the bell forming a cavity between an upper surface of the bell and a lower surface of the valve body, the bell further comprising an aperture connecting the inner area with the cavity; and where the valve body further comprises an outlet adjacent to an outer wall of the valve body and a duct connecting the cavity with the outlet.

* * * * *